US009093247B2

(12) United States Patent
Rogers et al.

(10) Patent No.: US 9,093,247 B2
(45) Date of Patent: Jul. 28, 2015

(54) METHOD AND APPARATUS OF DIFFERENTIAL PUMPING IN AN X-RAY TUBE

(75) Inventors: Carey Shawn Rogers, Brookfield, WI (US); Richard Michael Roffers, Menomonee Falls, WI (US)

(73) Assignee: General Electric Company, Schenectady, NY (US)

( * ) Notice: Subject to any disclaimer, the term of this patent is extended or adjusted under 35 U.S.C. 154(b) by 344 days.

(21) Appl. No.: 13/358,900

(22) Filed: Jan. 26, 2012

(65) Prior Publication Data

US 2012/0121065 A1 May 17, 2012

Related U.S. Application Data

(63) Continuation of application No. 12/893,614, filed on Sep. 29, 2010, now Pat. No. 8,126,115, which is a continuation of application No. 12/119,281, filed on May 12, 2008, now Pat. No. 7,881,436.

(51) Int. Cl.
*H01J 35/16* (2006.01)
*H01J 35/10* (2006.01)

(52) U.S. Cl.
CPC ..... *H01J 35/16* (2013.01); *H01J 35/101* (2013.01); *H01J 2235/1086* (2013.01); *H01J 2235/1204* (2013.01); *H01J 2235/1262* (2013.01); *H01J 2235/165* (2013.01); *H01J 2235/167* (2013.01); *H01J 2235/168* (2013.01); *H01J 2235/20* (2013.01); *Y10T 29/49826* (2015.01)

(58) Field of Classification Search
CPC ..... H01J 35/16; H01J 35/18; H01J 2235/186; H01J 2235/122; H01J 2235/1262; H01J 2235/168
USPC ..... 378/123, 140
See application file for complete search history.

(56) References Cited

U.S. PATENT DOCUMENTS

| | | | | |
|---|---|---|---|---|
| 4,521,901 | A | 6/1985 | Rand | |
| 4,607,380 | A * | 8/1986 | Oliver | 378/138 |
| 5,077,781 | A * | 12/1991 | Iversen | 378/200 |
| 5,340,122 | A | 8/1994 | Toboni et al. | |
| 6,115,454 | A * | 9/2000 | Andrews et al. | 378/140 |
| 6,519,318 | B1 | 2/2003 | Andrews | |
| 6,529,579 | B1 | 3/2003 | Richardson | |
| 6,901,136 | B1 | 5/2005 | Tekletsadik et al. | |
| 2003/0099327 | A1 | 5/2003 | Matsushita et al. | |
| 2004/0202282 | A1 * | 10/2004 | Miller | 378/140 |
| 2006/0034425 | A1 | 2/2006 | Unger et al. | |
| 2007/0140431 | A1 | 6/2007 | Miller | |
| 2007/0140432 | A1 | 6/2007 | Subraya et al. | |

* cited by examiner

*Primary Examiner* — Glen Kao
(74) *Attorney, Agent, or Firm* — Ziolkowski Patent Solutions Group, SC

(57) ABSTRACT

An x-ray tube includes a casing having a cathode and an anode enclosed therein, and a separator attached to an inner wall of the casing and having a conductance limiter therein, the separator positioned to separate the anode from the cathode.

19 Claims, 5 Drawing Sheets

METHOD AND APPARATUS OF DIFFERENTIAL PUMPING IN AN X-RAY TUBE

CROSS REFERENCE TO RELATED APPLICATIONS

The present application is a continuation of and claims priority to U.S. patent application Ser. No. 12/893,614 filed Sep. 29, 2010, which is a continuation of U.S. patent application Ser. No. 12/119,281 filed May 12, 2008 and issued as U.S. Pat. No. 7,881,436, the disclosures of which are incorporated herein.

BACKGROUND OF THE INVENTION

The invention relates generally to x-ray tubes and, more particularly, to a method and apparatus of reducing high-voltage activity therein.

X-ray systems typically include an x-ray tube, a detector, and a rotatable assembly to support the x-ray tube and the detector. In operation, an imaging table, on which an object is positioned, is located between the x-ray tube and the detector. The x-ray tube typically emits radiation, such as x-rays, toward the object while the x-ray tube and detector are rotated about the object. The radiation typically passes through the object on the imaging table and impinges on the detector. As radiation passes through the object, internal structures of the object cause spatial variances in the radiation received at the detector. The detector then transfers data received, and the system translates the radiation variances into an image, which may be used to evaluate the internal structure of the object. One skilled in the art will recognize that the object may include, but is not limited to, a patient positioned in a medical imaging scanner and an inanimate object as in, for instance, a package in a computed tomography (CT) package scanner.

X-ray tubes typically include an anode having a high density track material, such as tungsten, that generates x-rays when high energy electrons impinge thereon. The anode structure typically includes a target cap and a heat storage unit, such as graphite, attached thereto. X-ray tubes also include a cathode that has a filament and a high voltage applied thereto to provide a focused electron beam. The focused electron beam comprises electrons that emit from the filament, typically tungsten, and are accelerated across an anode-to-cathode vacuum gap to produce x-rays upon impact with the track material. The anode and the cathode are typically positioned within a single volume that is maintained at a single vacuum level.

Because of the high temperatures generated when the electron beam strikes the track material, the anode assembly is typically rotated at high rotational speed. The anode typically includes a cylindrical rotor built into a cantilevered axle that supports the anode. An iron stator structure with copper windings surrounds the rotor and causes rotation of the anode via the rotor. The heat storage unit receives heat generated at the focal spot via conduction, and radiates the heat to the surrounding walls of the vacuum enclosure, where the heat is carried away by a coolant located outside the walls. The heat storage unit increases the heat capacity of the anode assembly, thus enabling longer and more frequent imaging sessions to be performed before the components of the x-ray tube overheat. The anode is typically mounted on a bearing assembly and rotated by an induction motor, and the bearing is typically placed within the vacuum region of the x-ray tube. The bearing assembly typically includes tool steel ball bearings and tool steel raceways positioned within the vacuum region, therefore a solid lubricant such as silver is typically adhered to the balls to increase the life of the bearings.

Because of the high voltage requirements, the x-ray tube is susceptible to high voltage discharges, or "spits," which interfere with operation of the x-ray system and lead to early life failure of the tube. Discharges occur as a result of high voltage operation in the presence of gases or particulate material within the x-ray tube (which raise its pressure), and the area surrounding the cathode is particularly susceptible to spit activity.

This phenomenon is exacerbated for a monopolar, or anode-grounded, tube design as compared to a bipolar design. When, for instance, a −140 kV voltage differential is maintained between the cathode and the anode and the tube is a bipolar design, the cathode may be maintained at, for instance, −70 kV, and the anode may be maintained at +70 kV. As such, the voltage differential between the cathode and the surrounding components at ground (and not the anode) is a net 70 kV. In contrast, for a monopolar design having likewise a −140 kV standoff between the cathode and the anode, the cathode accordingly is maintained at this higher potential of −140 kV while the anode is grounded and thus maintained at approximately 0 kV. Accordingly, the anode is operated having a net 140 kV difference with surrounding components within the tube. Thus, a monopolar tube design has increased voltage stand-off requirements for particularly the cathode, and therefore has increased sensitivity to gas and particulate in the area of the cathode. The high potential of the cathode in a monopolar design thus increases the propensity for high voltage activity in the cathode region as compared to a bipolar design. And such propensity is further exacerbated as gases and particulates collect within the vacuum region (thus raising its pressure) during the life of the tube.

Gases and particulates in an x-ray tube may emit from several sources. Such sources include, but are not limited to, the walls of the enclosure, the cathode components, and the anode components. For instance, the tungsten filament sublimates as a result of high temperature operation, thus causing tungsten particulate to emit into the vacuum region. Additionally, the walls of the enclosure, having a high surface area and typically an emissive coating thereon, emit gas into the vacuum region. The emission of gas and particulate matter is compounded as the operating temperature increases.

Furthermore, the anode itself typically has several sources from which gas and particulate matter may emit. Graphite in the anode, for instance, emits particulate and gas and is one of the worst offenders for causing high voltage activity. The bearing, likewise, emits particulate as a result of wear and is also a major source of particulate contaminants within an x-ray tube. Thus, by its operation, an x-ray tube typically includes a number of sources from which contaminant within the vacuum region may derive.

Commonly, the vacuum level in an x-ray tube is statically maintained and the vacuum region is evacuated at elevated temperature and sealed off. Gettering material is sometimes included in the vacuum vessel to aid in vacuum level retention. When the vacuum vessel is hermetically sealed via solid joints, the vacuum levels can be maintained so that the x-ray tube has a reasonably long operational life. However, if a constant gas source is included in the x-ray tube (e.g. a ferrofluidic rotating seal), additional vacuum pumping may be included to maintain the vacuum level during the tube life.

Typically, despite the various sources of contaminants, the vacuum level of the x-ray tube may be maintained by a single vacuum pump, such as an ion pump with a capacity of, for instance 8 l/s. However, such a pump is typically fairly bulky and is sized in order to properly pump the relatively large amounts of contaminants that emanate from primarily the anode and bearing in order to maintain the very high vacuum level around, for instance, the cathode.

The effect of gas and particulate emission from sources can be minimized to some extent by implementing design improvements or alternatives in an x-ray tube. For instance, an x-ray tube cathode is typically designed to have smoothed and rounded surfaces. And proper spacing between the anode, the cathode, and the surrounding components is typically maintained in the design to minimize the propensity for high voltage discharge. Such design activities represent practices that are developed with experience in the industry and may result in an increased tolerance of gas and particulate contamination within the vacuum.

As another example of gas and particulate emission reduction in x-ray tube design, the bearing may be placed outside the vacuum region by use of, for instance, a ferrofluid seal. Because the bearings may be positioned outside the vacuum region, they may be oil lubricated and may be designed to have greater load-bearing capacity than conventional x-ray tube bearings. A ferrofluid seal typically includes a series of annular regions between a rotating component and a non-rotating component. The annular regions are occupied by a ferrofluid that is typically a hydrocarbon-based or fluorocarbon-based oil with a suspension of magnetic particles therein. The particles are coated with a stabilizing agent, or surfactant, which prevents agglomeration of the particles in the presence of a magnetic field. When in the presence of a magnetic field, the ferrofluid is caused to form a seal between each of the annular regions. The seal on each annular region, or stage, can separately withstand pressure of typically 1-3 psi and, when each stage is placed in series, the overall assembly can withstand pressure varying from atmospheric pressure on one side to high vacuum on the other side.

The ferrofluid seal allows rotation of a shaft therein designed to deliver mechanical power from the rotor on one side of the seal to the anode on the other side. As such, the rotor may be placed outside the vacuum region and particulate generated due to bearing wear may be prevented from passing from the bearing to the vacuum region. However, while ferrofluid seals hermetically seal one side from the other, gas and water vapor may diffuse through the ferrofluid and into the high-vacuum region of the x-ray tube. In addition, the hydrocarbon-based or fluorocarbon-based oil used in the ferrofluid tends to evaporate or otherwise emit into the high-vacuum region of the x-ray tube as well. Accordingly, ionizable gases that transport through the seal or emit from the ferrofluid oil, when exposed to the high voltage environment of an x-ray tube, may lead to ionization failure of the x-ray tube, thus introducing a source of contaminant into the vacuum region.

Contaminants in an x-ray tube may also be minimized by use of proper cleaning and handling during the manufacturing process. However, despite even the efforts of special cleaning and processing of the components, gases and particulates may yet accumulate within the x-ray tube as a result of operation of the tube, thus increasing the tube pressure and causing increased high voltage activity that may lead to early life failure.

Therefore, it would be desirable to design an apparatus and method to minimize gas and particulate within an x-ray tube, thus improving the vacuum level surrounding the cathode of an x-ray tube and reducing high-voltage activity therein.

BRIEF DESCRIPTION OF THE INVENTION

The invention provides a method and apparatus for improving an x-ray tube that overcomes the aforementioned drawbacks.

According to one aspect of the invention, an x-ray tube includes an anode, a first chamber enclosing the anode and having a first pressure therein, a cathode, and a second chamber enclosing the cathode and having a second pressure therein. A separator is positioned between the first and second chambers and has a conductance limiter therein.

In accordance with another aspect of the invention, a method of manufacturing an x-ray tube includes the steps of enclosing an anode in a first compartment, enclosing a cathode in a second compartment, providing a separator with a passageway therein, and positioning the separator between the first compartment and the second compartment such that electrons that emit from the cathode to the anode pass through the passageway.

Yet another aspect of the invention includes an x-ray system that includes a detector positioned to receive x-rays that pass through an object and an x-ray tube positioned to emit the x-rays toward the object. The x-ray tube includes a chamber, a separator positioned in the chamber to form a first sub-chamber and a second sub-chamber, and a target positioned in the first sub-chamber. The x-ray tube further includes a cathode positioned in the second sub-chamber to emit electrons toward the target to generate the x-rays, a passageway in the separator positioned to allow passage of the electrons from the cathode to the target therethrough, and a pair of pressure-reducing devices, each pressure-reducing device fluidically coupled to a respective one of the first and second sub-chambers.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
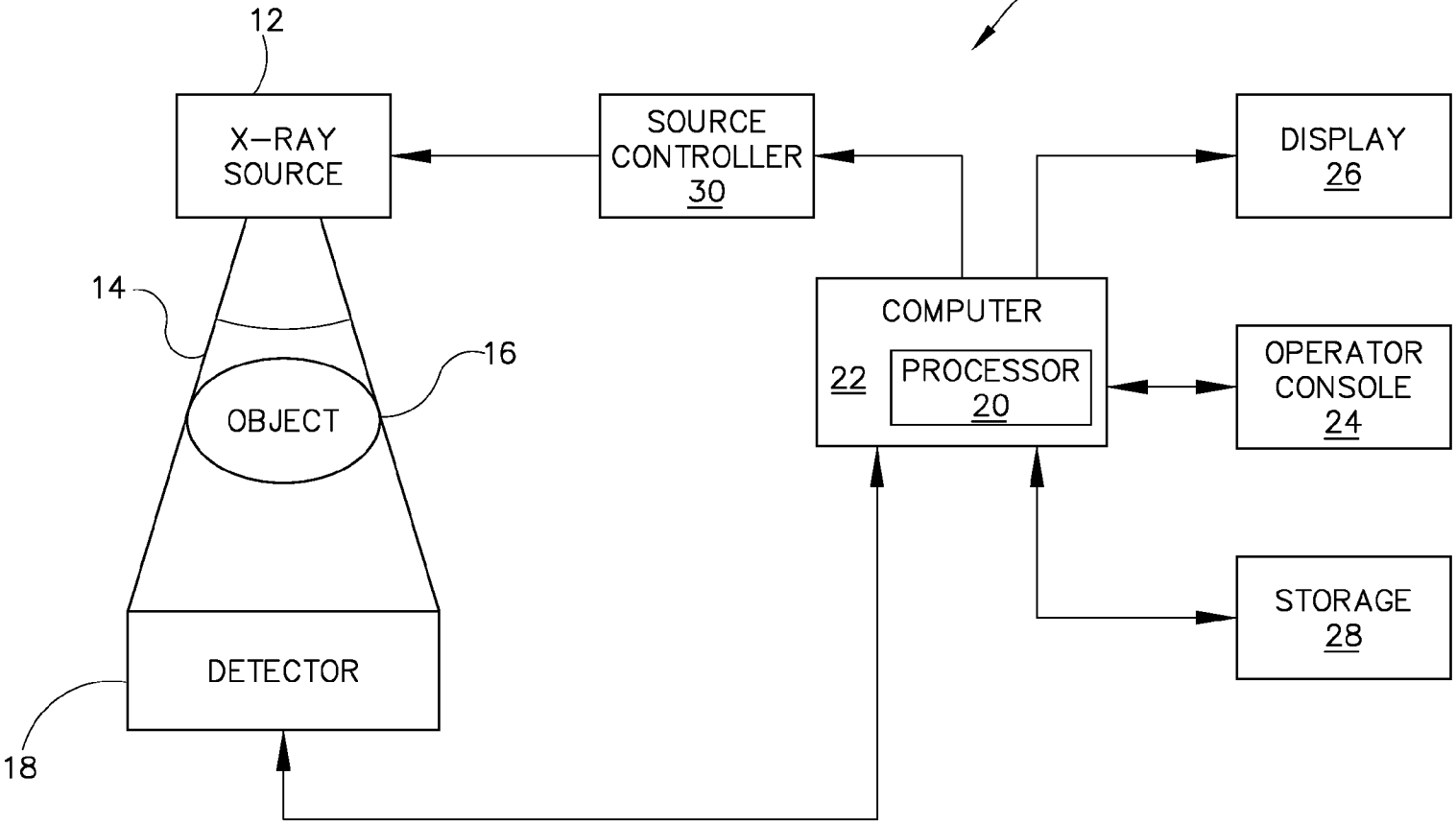
FIG. 1 is a block diagram of an imaging system that can benefit from incorporation of an embodiment of the invention.

FIG. 1 is a block diagram of an embodiment of an imaging system 10 designed to acquire original image data and to process the image data for display and/or analysis. It will be appreciated by those skilled in the art that embodiments of the invention are applicable to numerous medical imaging systems implementing an x-ray tube, such as x-ray or mammography systems. Other imaging systems or modalities such as computed tomography systems and digital radiography systems, which acquire image three dimensional data for a volume, also benefit from embodiments of the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector; however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

While embodiments of the invention will be described with respect to their use in an x-ray tube, one skilled in the art will appreciate that the embodiments are equally applicable for other systems that require operation of a target used for the production of x-rays wherein high peak temperatures are driven by peak power requirements.

Figure 2:
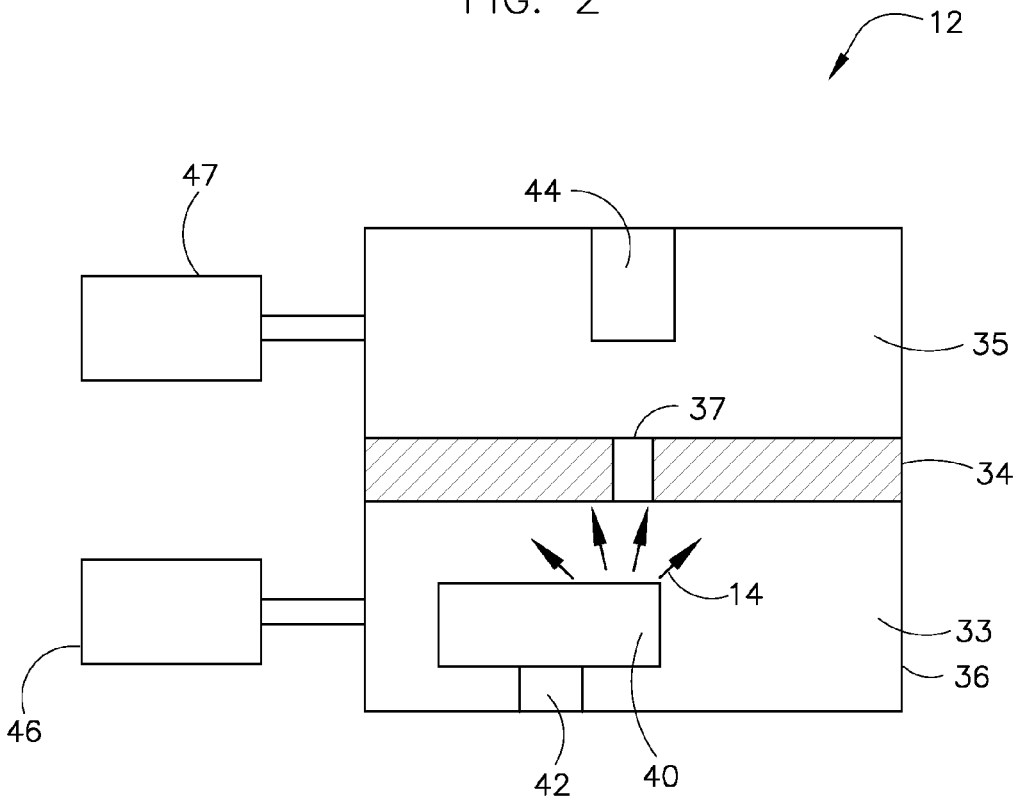
FIG. 2 is a cross-sectional view of an x-ray tube according to an embodiment of the invention.

FIG. 2 illustrates a cross-sectional view of an x-ray source, such as x-ray tube 12 of FIG. 1, according to an embodiment of the invention. In this embodiment, x-ray source 12 includes a casing 36 having a first chamber 33 and a second chamber 35, separated by a plate, or separator 34. A slot 37 is positioned in the separator 34. The slot 37 may include, but is not limited to an aperture, a restrictor, a passageway, or a conductance limiter. In one embodiment the slot includes a material therein that allows passage of electrons therethrough. An anode 40, supported by a shaft 42, is positioned in the first chamber 33. A cathode 44 having filaments (not shown) is positioned in the second chamber 35 and positioned proximate the slot 37. In embodiments of the invention, a first pressure-reducing device 46 is coupled to the first chamber 33 and a second pressure-reducing device 47 is coupled to the second chamber 35.

In operation, electrons are caused to emit from cathode 44 by passing an electrical current through its filaments. The electrons are accelerated by the voltage potential (such as 140 kV), which is maintained between the cathode 44 and the restrictor plate 34, and the anode 40 likewise is maintained, according to this embodiment, at approximately the same voltage potential as the restrictor plate 34, and pass through slot 37 of plate 34. X-rays 14 are produced when the electrons are suddenly decelerated when they encounter the anode 40. To avoid overheating the anode 40 from the electrons, a rotor (not shown) rotates the anode 40 at a high rate of speed at, for example, 50-250 Hz. One skilled in the art will recognize that the restrictor plate 34 and the anode 40 may be maintained at different potentials from each other to optimize performance, thus with it is possible to maintain the cathode 44 at a first potential, the restrictor 34 at a second potential, and the anode 40 at a third potential in a manner that, in this embodiment, is not limited to bipolar or monopolar operation.

Figure 3:
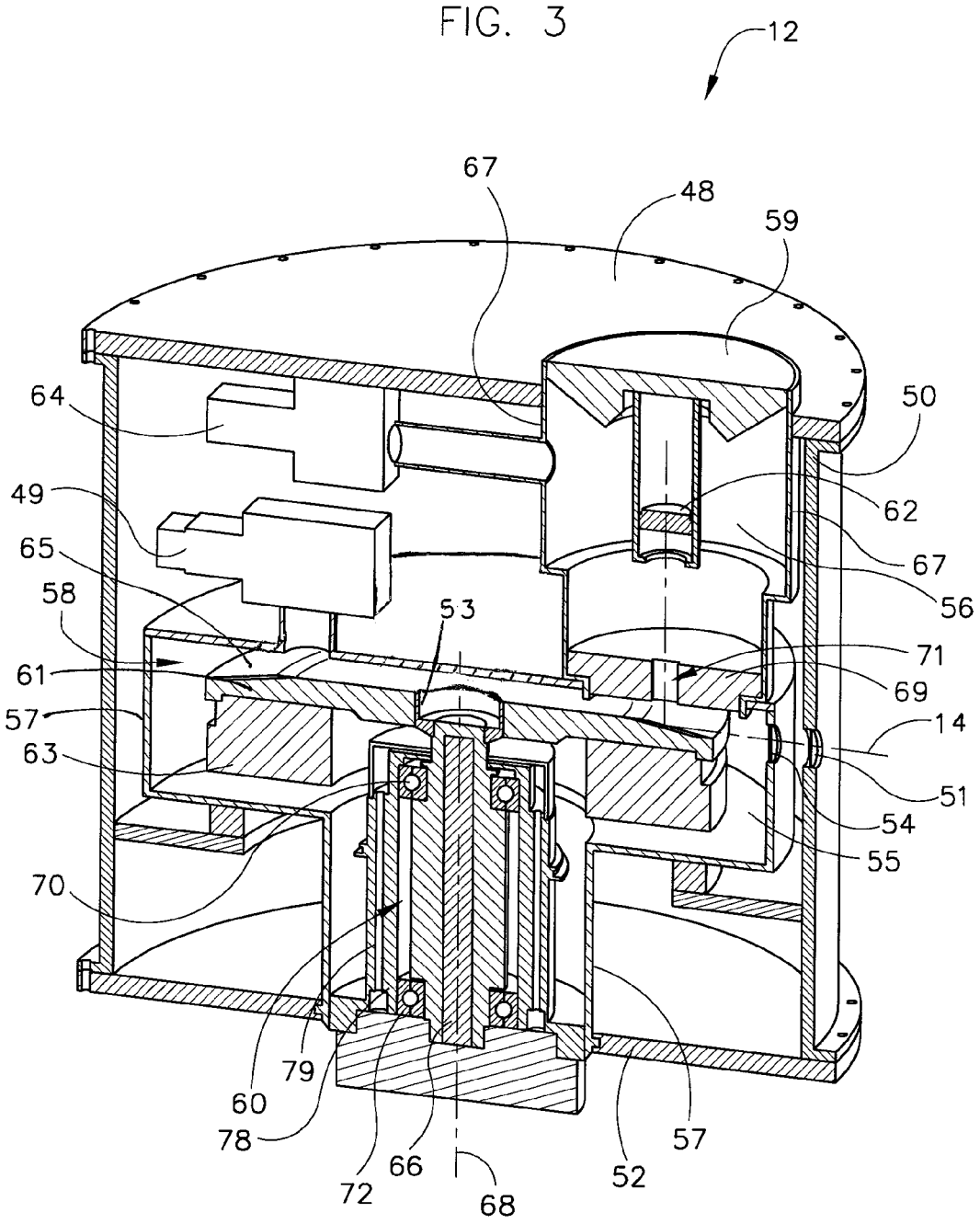
FIG. 3 is a cross-sectional view of an x-ray tube according to an embodiment of the invention.

FIG. 3 illustrates a cross-sectional view of an x-ray tube, such as x-ray tube 12 of FIG. 1, according to another embodiment of the invention. X-ray tube 12 includes a casing, or frame 50, and a pair of backplates 52, 48 that support a pair of chambers, compartments, or volumes 55, 56. First volume 55 is encircled by a housing 57 and is maintained at a high vacuum via a pressure-reducing device or vacuum pumping unit 49, such as an ion pump, a vacuum pump, and a getter, fluidically attached thereto. A low density window material 54, such as beryllium, is positioned in the housing 57, and a low density material 51, such as aluminum or plastic, is positioned in the casing 50 adjacent to the low density window material 54. An anode assembly 58 is positioned in and enclosed by first volume 55 and includes a bearing assembly 60 and a target cap 61. Target cap 61 has a track material 65 attached thereto for the generation of x-rays and has a heat-sink 63 also attached thereto constructed of a material such as graphite. Bearing assembly 60 includes a front bearing 70 and a rear bearing 72, which together support a center shaft 66 to which target cap 61 is attached via a hub 53 and is positioned within a stem 78 that has cooling lines 79 therein.

Second volume 56 is encircled by a housing 67 and a high-voltage insulator 59. Second volume 56 encloses a cathode 62 and is maintained at high vacuum via a pressure-reducing device or vacuum pumping unit 64, such as an ion pump, a vacuum pump, and a getter, fluidically attached thereto. Cathode 62 includes one or more filaments (not shown), which have electrical connections attached thereto (not shown) that pass through the high-voltage insulator 59. A restrictor plate, or separator 69, having a slot or passageway 71 therein is positioned between first volume 55 and second volume 56.

The slot 71 in the restrictor plate 69 has a size that is selected to be just large enough to allow passage of the electrons emitting from the cathode 62 to pass to the anode assembly 58 without interfering therewith, and impinge upon the track material 65. In one embodiment, for an x-ray tube target cap 61 having a track material 65 positioned thereon with, for instance, a 7 degree target angle, and an electron beam having a cross-section of for instance 1.5 mm width by 10 mm length, the slot size is approximately 2 mm width and 11 mm length. To minimize the conductance between first volume 55 and second volume 56, the slot is preferentially of rectangular cross-section having, in one embodiment a 10:1 cross-sectional area, although one skilled in the art will recognize that other cross-sections are applicable. In the molecular flow regime, in which an x-ray tube base vacuum level resides, the conductance of a rectangular slot is proportional to the product of the length of the slot and the square of the width of the slot divided by the length of the passageway. Thus, the thickness of the restrictor plate is selected to provide vacuum conduction resistance between the first volume 55 and the second volume 56 and, in embodiments described herein, ranges from approximately 2 mm to 25 mm in thickness.

In operation, electrons are caused to emit from cathode 62 by passing an electrical current through its filaments, and by maintaining the restrictor plate 69 at anode potential. The electrons are accelerated by the voltage potential (such as 140 kV), which is maintained between the cathode 62 and the restrictor plate 69, and the anode assembly 58 likewise is maintained, according to this embodiment, at approximately the same voltage potential as the restrictor plate 69, and pass through slot 71 of plate 69. X-rays 14 are produced when the electrons are suddenly decelerated when they encounter track material 65. In one embodiment, the anode assembly 58 and the restrictor plate 69 are maintained at ground potential. The x-rays 14 emitted pass through window material 54 and through low density material 51 toward a detector array (not shown), such as the detector array 18 of FIG. 1. To avoid overheating target cap 61 from the electrons, a rotor (not shown) attached to center shaft 66 rotates target cap 61 at a high rate of speed about a centerline 68 at, for example, 50-250 Hz. One skilled in the art will recognize that the restrictor plate 69 and the anode assembly 58 may be maintained at different potentials from each other to optimize performance, thus with it is possible to maintain the cathode 62 at a first potential, the restrictor at a second potential, and the anode assembly at a third potential in a manner that, in this embodiment, is not limited to bipolar or monopolar operation.

Due to the proximity of the restrictor plate 69 to the rotating anode 58, the restrictor plate 69 is subject to high thermal loads resulting from infra-red radiation emission from the hot rotating target cap 61 and from backscattered electrons rebounding from the target cap 61. Consequently, the restrictor plate 69 is typically engineered to survive this environment. In one such embodiment, cooling channels (not shown) are provided to the restrictor plate 69. In a further embodiment, the restrictor plate 69 is fabricated from refractory metals that can withstand very high temperatures, for example, molybdenum and tungsten alloys. This embodiment has a further benefit of providing local radiation shielding near to a focal spot point of generation, shielding both the external environment of the x-ray tube 12 and the second volume 56 from high energy charged and neutral particles emanating from the first volume 55. In this embodiment, the second volume 56 is effectively isolated from the higher contamination first volume 56, thereby creating a highly favorable vacuum volume surrounding the high-voltage cathode 62 and resulting in superior high voltage stability of the x-ray tube 12.

As shown in FIG. 3, anode assembly 58 and cathode 62 are positioned in separate chambers, or sub-chambers 55, 56 and are separated by plate 69 having the slot 71 therein. Because the components of x-ray tube 12 may have differing levels of contaminant sources therein and differing levels of susceptibility to high voltage instability, it is contemplated that chambers 55, 56 may have their vacuum levels controlled to different levels of vacuum by the use of the two vacuum pumping units 49, 64. However, it is also contemplated that chambers 55, 56 may have their vacuum levels controlled to similar levels of vacuum.

In one embodiment of the invention, both vacuum pumping units 49, 64 have pumping capacities of 2 l/s. According to another embodiment of the invention, pumping units 49, 64 may have capacities different from one another, such as, for instance, 4 l/s for pumping unit 49 and 2 l/s for pumping unit 64. As such, as an example, first volume 55 enclosing the anode assembly 58 has a higher amount of contaminant than second volume 56 enclosing cathode 62 by virtue of the different pump capacities. Because cathode 62 may be less tolerant to the presence of contaminants, such an arrangement may extend the life of the x-ray tube 12. As such, one skilled in the art will recognize that the pumping units 49, 64 may each be sized such that overall performance within the x-ray tube 12 is optimized to prevent gases and particulates from backstreaming into the second volume 56. This differential pumping across the restrictor plate 69 can maintain a cleaner and higher level of vacuum in the cathode vessel compared to the anode vessel, thereby improving high voltage stability of the x-ray tube.

In the embodiment illustrated in FIG. 3, front and rear bearings 70, 72 are positioned within first volume 55. Because first volume 55 is maintained at a high vacuum, the bearings 70, 72 are precluded from being lubricated with a liquid lubricant and are, instead, typically lubricated using a solid lubricant such as, for instance, silver. In the design illustrated, the bearings 70, 72 are sealed from a surrounding environment outside the x-ray tube 12 and are operated under vacuum for the life of the tube. However, conventional solid lubricated x-ray tube bearings typically emit, as stated, particulate matter into the x-ray tube environment. Also, such bearings are typically positioned within very limited design space, and thus their overall load-bearing capacity may be limited.

Figure 4:
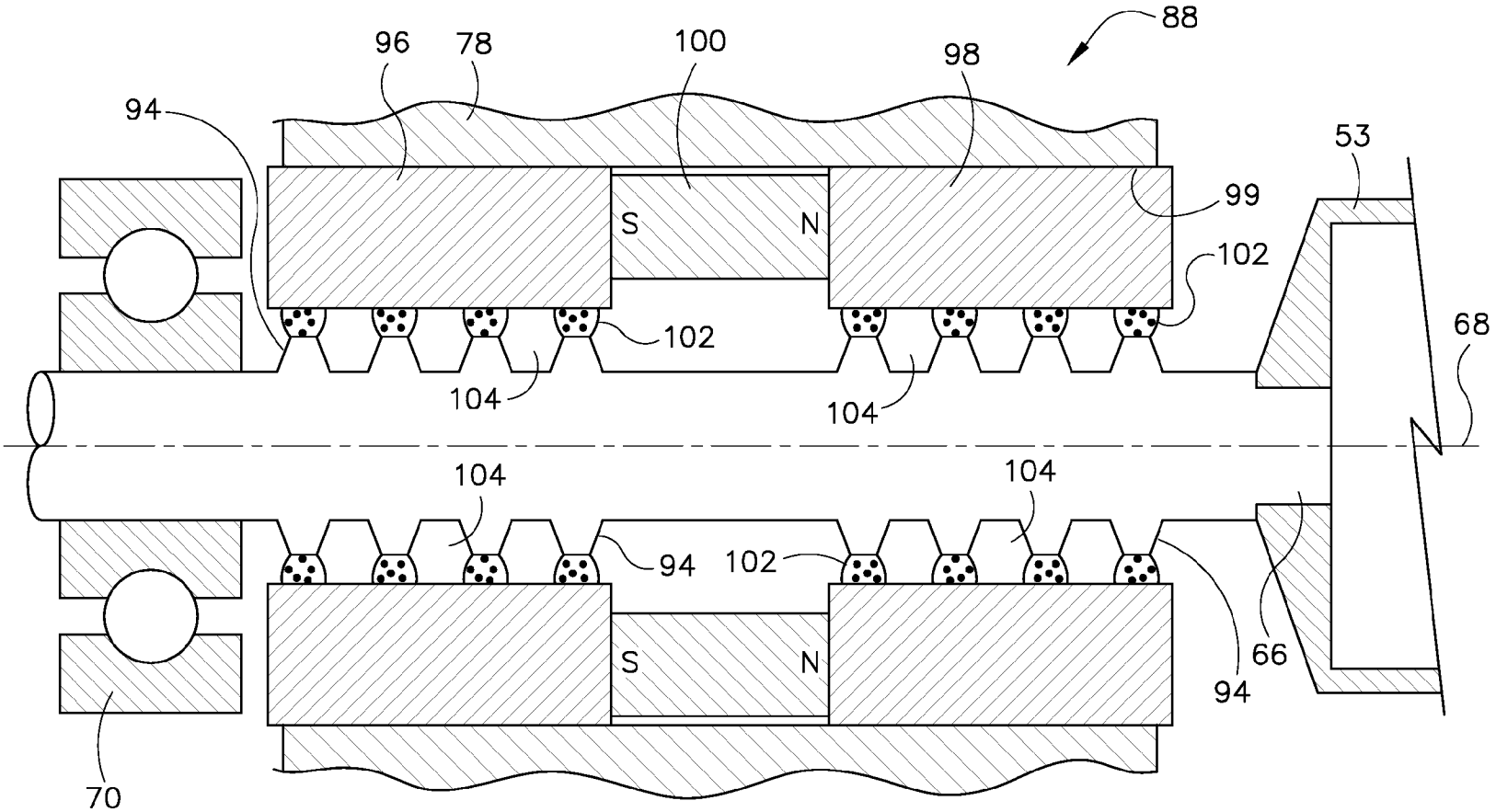
FIG. 4 illustrates a cross-sectional view of a ferrofluid seal assembly according to an embodiment of the invention.

As such, according to another embodiment of the invention, a ferrofluid seal, such as the ferrofluid seal 88 shown in FIG. 4, may be positioned between front bearing 70 and hub 53 such that bearing assembly 60 is not enclosed within first volume 55. Accordingly, ferrofluid seal assembly 88 hermetically seals and separates, in this embodiment, first volume 55 from bearings 70, 72. A pair of annular pole pieces 96, 98 abut an interior surface 99 of stem 78 and encircle center shaft 66 that is centered the centerline 68.

An annular permanent magnet 100 is positioned between pole piece 96 and pole piece 98. In a preferred embodiment, center shaft 66 includes annular rings 94 extending therefrom toward pole pieces 96, 98. Alternatively, however, pole pieces 96, 98 include annular rings extending toward center shaft 66 instead of, or in addition to, annular rings 94 of center shaft 66. A ferrofluid 102 is positioned between each annular ring 94 and corresponding pole piece 96, 98, thereby forming cavities 104. Magnetization from permanent magnet 100 retains ferrofluid 102 positioned between each annular ring 94 and corresponding pole piece 96, 98 in place. In this manner, multiple stages of ferrofluid 102 are formed that hermetically seal the region containing bearings 70, 72 from high vacuum first volume 55. As shown, FIG. 4 illustrates 8 stages of ferrofluid 102. Each stage of ferrofluid 102 withstands 1-3 psi of gas pressure. Accordingly, one skilled in the art will recognize that the number of stages of ferrofluid 102 may be increased or decreased, depending on the difference in pressure that is carried by ferrofluid seal 88.

Thus, according to an embodiment of the invention, x-ray tube 12 of FIG. 3 includes a ferrofluid seal, such as the ferrofluid seal 88 illustrated in FIG. 4. And, because the presence of a ferrofluid seal may either increase or decrease the total number of contaminant sources fluidically connected to first volume 55 (e.g., bearing particulate may be prevented from entering first volume 55, but gas emission through and from ferrofluid 102 may increase the amount of contaminant), pumping units 49, 64 may be sized accordingly to optimize removal of particulates within volumes 55, 56, as will be recognized by one skilled in the art.

Figure 5:
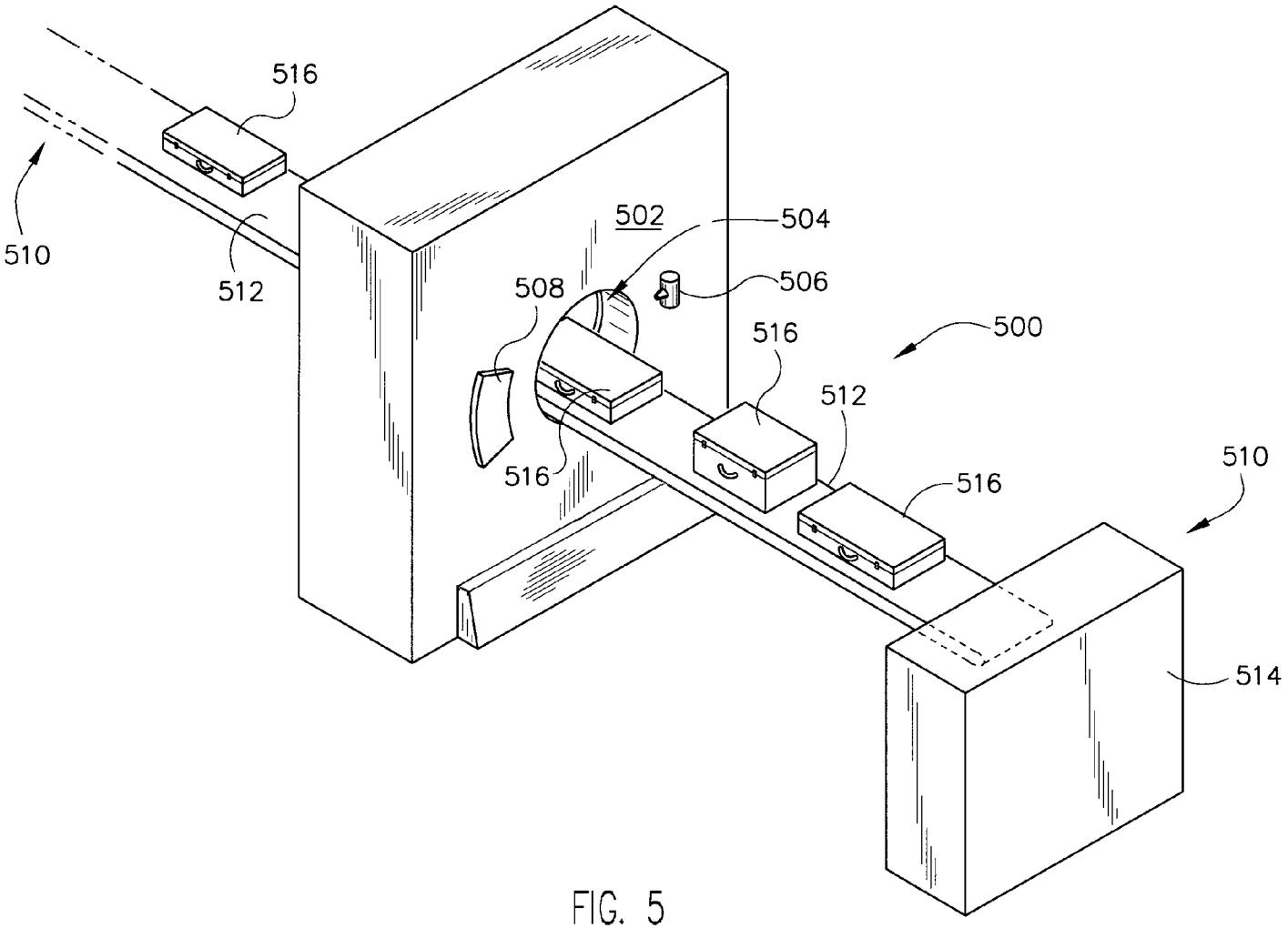
FIG. 5 is a pictorial view of an x-ray system for use with a non-invasive package inspection system.

FIG. 5 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Therefore, according to one embodiment of the invention, an x-ray tube includes an anode, a first chamber enclosing the anode and having a first pressure therein, a cathode, and a second chamber enclosing the cathode and having a second pressure therein. A separator is positioned between the first and second chambers and has a conductance limiter therein.

In accordance with another embodiment of the invention, a method of manufacturing an x-ray tube includes the steps of enclosing an anode in a first compartment, enclosing a cathode in a second compartment, providing a separator with a passageway therein, and positioning the separator between the first compartment and the second compartment such that electrons that emit from the cathode to the anode pass through the passageway.

Yet another embodiment of the invention includes an x-ray system that includes a detector positioned to receive x-rays that pass through an object and an x-ray tube positioned to emit the x-rays toward the object. The x-ray tube includes a chamber, a separator positioned in the chamber to form a first sub-chamber and a second sub-chamber, and a target positioned in the first sub-chamber. The x-ray tube further includes a cathode positioned in the second sub-chamber to emit electrons toward the target to generate the x-rays, a passageway in the separator positioned to allow passage of the electrons from the cathode to the target therethrough, and a pair of pressure-reducing devices, each pressure-reducing device fluidically coupled to a respective one of the first and second sub-chambers.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:

a housing having a cathode and an anode enclosed therein; and a separator attached to an inner wall of at least one of a first chamber and second chamber within the housing and having a conductance limiter formed therethrough in a first direction, the separator positioned within the housing to separate the anode from the cathode;

wherein a first surface of the separator that is positioned perpendicular the first direction is exposed to a fluid surrounding one of the anode and the cathode; and wherein the anode and the separator are maintained at approximately a first potential, and the cathode is maintained at a second potential that is different from the first potential.

2. The x-ray tube of claim 1 wherein the conductance limiter is positioned to allow electron passage therethrough from the cathode to the anode; and wherein a second surface of the separator, opposite the first surface, is exposed to a fluid surrounding the other of the anode and the cathode.

3. The x-ray tube of claim 1 wherein the separator is positioned to form the first chamber having the anode therein and the second chamber having the cathode therein, the first chamber having a first pressure and the second chamber having a second pressure.

4. The x-ray tube of claim 3 wherein the second pressure is lower than the first pressure.

5. The x-ray tube of claim 3 comprising:

a first pressure-reducing device coupled to the first chamber;

a second pressure-reducing device coupled to the second chamber;

a bearing assembly coupled to a center shaft of the anode; and a ferrofluid seal surrounding the center shaft and configured to hermetically seal the bearing assembly from the first chamber; and wherein the anode comprises a rotatable anode.

6. The x-ray tube of claim 1 wherein a thickness of the separator is between 2 and 25 mm.

7. The x-ray tube of claim 1 wherein the conductance limiter is uniform in cross-section through an entire depth of the separator; and wherein the first chamber is separated from the second chamber by a distance equal to a thickness of the separator.

8. The x-ray tube of claim 1 wherein the separator is configured to withstand thermal loading from the anode by way of at least one of a refractory metal and cooling channels provided to the separator.

9. The x-ray tube of claim 1 wherein the separator comprises one of a molybdenum alloy and a tungsten alloy.

10. A method of manufacturing an x-ray tube comprising:

providing a housing having an inner volume;

providing a restrictor plate having a slot extending through a thickness thereof;

attaching the restrictor plate to an inner wall of the housing such that the inner volume is divided by the restrictor plate into a first compartment and a second compartment and such that a surface of the restrictor plate facing an anode is exposed to a fluid surrounding the anode;

positioning the anode within the first compartment;

positioning a cathode within the second compartment; and configuring the restrictor plate to withstand high thermal loads by way of providing cooling channels to the restrictor plate.

11. The method of claim 10 wherein the slot is selectively positioned such that electrons pass from the cathode to the anode.

12. The method of claim 10 comprising coupling a first pressure-reducing device to the first compartment and coupling a second pressure-reducing device to the second compartment.

13. The method of claim 10 wherein the slot in the restrictor plate comprises a uniform cross-section through an entire thickness of the restrictor plate.

14. The method of claim 10 comprising:

selecting a thickness of the restrictor plate to be between 2 and 25 mm;

wherein providing the restrictor plate comprises providing the restrictor plate having the thickness between 2 and 25 mm.

15. An x-ray system comprising:

a detector positioned to receive x-rays that pass through an object;

a source controller; and an x-ray tube positioned to emit the x-rays toward the object, the x-ray tube comprising:

a housing having a first chamber and a second chamber, the second chamber having a cathode positioned therein and the first chamber having an anode positioned therein; and a restrictor plate positioned within the housing and attached to an inner wall of at least one of the first chamber and the second chamber of the housing, the restrictor plate having a passageway therein positioned to allow electron passage from the cathode to the anode to generate the x-rays therefrom;

wherein the first chamber is separated from the second chamber by a distance equal to a length of the passageway; and wherein the source controller is configured to apply a first voltage to the anode and the restrictor plate and a second voltage to the cathode, the second voltage different from the first voltage.

16. The x-ray system of claim 15 wherein the restrictor plate is positioned to form the first chamber having the anode therein and the second chamber having the cathode therein, the first chamber having a first pressure-reducing device coupled thereto and the second chamber having a second pressure pressure-reducing device coupled thereto.

17. The x-ray system of claim 16 wherein the source controller is configured to maintain a pressure in the second chamber to be lower than a pressure in the first chamber via the second pressure-reducing device and via the first pressure-reducing device.

18. The x-ray system of claim 15 wherein the restrictor plate is configured to withstand thermal loading from the anode by way of at least one of a refractory metal and cooling channels provided to the restrictor plate.

19. The x-ray system of claim 15 wherein the restrictor plate comprises one of a molybdenum alloy and a tungsten alloy.

* * * * *